United States Patent [19]

Stäheli et al.

[11] 4,222,154

[45] Sep. 16, 1980

[54] FIBRE FLOCK MATERIAL FEED APPARATUS FOR OPENING ROLLS

[75] Inventors: Paul Stäheli, Wilen near Wil; Paul Welti, Winterthur, both of Switzerland

[73] Assignee: Rieter Machine Works Ltd., Winterthur, Switzerland

[21] Appl. No.: 922,816

[22] Filed: Jul. 10, 1978

[30] Foreign Application Priority Data

Jul. 18, 1977 [CH] Switzerland ..... 8850/77

[51] Int. Cl.[2] ..... D01G 15/40; D01G 23/00

[52] U.S. Cl. ..... 19/105; 19/204

[58] Field of Search ..... 19/105, 86, 96, 204, 19/97.5, 64.5

[56] References Cited

U.S. PATENT DOCUMENTS

| | | | |
|---|---|---|---|
| 1,462 | 12/1839 | Freeman | 19/105 |
| 3,537,144 | 11/1970 | King, Jr. | 19/105 X |

FOREIGN PATENT DOCUMENTS

| | | | |
|---|---|---|---|
| 2635534 | 3/1977 | Fed. Rep. of Germany | 19/105 |
| 12714 | of 1849 | United Kingdom | 19/105 |
| 2171 | of 1863 | United Kingdom | 19/105 |
| 299 | of 1874 | United Kingdom | 19/105 |

*Primary Examiner*—Louis Rimrudt

*Attorney, Agent, or Firm*—Werner W. Kleeman

[57] ABSTRACT

A feed apparatus for a fibre layer on an opening roll of cards or spinning preparatory machines fed with the fibre layer, wherein a feeder plate together with a feed roll forms a clearance or gap extending from the entrance or mouth of the feeder plate. Immediately upstream of the feeder plate a presser member is arranged to be movable towards the feed roll into a position in which the fibre layer is compressed and at least to a distance essentially corresponding to the width of the clearance or gap at the entrance or mouth of the feeder plate.

16 Claims, 5 Drawing Figures

FIBRE FLOCK MATERIAL FEED APPARATUS FOR OPENING ROLLS

BACKGROUND OF THE INVENTION

The present invention concerns a new and improved fibre material feed apparatus having a feed roll and a feeder plate operatively associated therewith on an opening roll of cards or opening machines in spinning preparation.

Feed devices of the type mentioned are well known on cards. In such arrangements, for instance as exemplified by U.S. Pat. No. 2,983,966 or U.S. Pat. No. 2,442,333, normally a feed roll is arranged upstream of the licker-in roll of the card and, for instance, a feeder plate is arranged at a feed table upstream of the feed roll. This feeder plate in conjunction with the cylinder surface of the feed roll forms a feed gap or clearance through which the material is taken-in. This gap or clearance extends from an entrance or mouth end of the concave feeder plate to the other end thereof and terminates at the licker-in roll. The fibre material supplied to the card is engaged by the feed roll and taken into the clearance or gap and at the end of such clearance or gap is transferred to the zone of the rotating licker-in roll which opens the fibre material.

On cards as well as on opening machines, and thus, to the feed rolls of these machines, the fibre material is supplied, for instance, in the form of a fibre layer or lap consisting of coherent fibres. In the known feed devices the piecing and inserting of the fibre layer into the concave feeder plate is difficult and complicated, particularly if the feed roll has a large working width, as required, for example, on large cards. This is so because the front end of the fibre layer reaching the feed roll in many cases cannot be inserted and taken-in evenly and certainly not simultaneously into the clearance. Consequently, the fibre layer is not seized sufficiently and simultaneously across its entire working width by the feed roll. As the extent of the clearance or gap is small in relation to the thickness of the incoming fibre layer, there can be caused fibre material accumulations or damming-up of the fibre material, which also impairs the desired insertion. On the other hand, if the clearance or gap is chosen wider, the disadvantages mentioned above also are not eliminated. Since the central region or portion of the feed roll, particularly on cards of large working width, is only accessible with difficulty, the fibre layer also cannot be manually inserted or by using tools in the desired manner into the wedge-shaped clearance of the feed roll.

SUMMARY OF THE INVENTION

Hence, it is a primary object of the present invention to avoid the above-mentioned disadvantages and to create an automatic and disturbance-free intake for inserting the fibre layer into the clearance or gap between the feeder plate and the feed roll.

Still a further significant object of the present invention is to devise a new and improved construction of fibre flock material feed apparatus which enables orderly, positive and reliable insertion of a fibre layer into the clearance or gap between a feeder plate and a feed roll of a textile machine.

Yet another noteworthy object of the present invention is to automatically and reliably infeed fibre material and the like to opening rolls of textile equipment by providing structure which assists in achieving undisturbed insertion of the fibre material into a confined area with a minimum of effort and equipment expenditure.

A further important object of the present invention is to provide novel means for efficiently, reliably and automatically infeeding fibre material into a clearance or gap through which such fibre material must move as it is being processed at a related textile machine.

Now in order to implement these and still further objects of the invention, which will become more readily apparent as the description proceeds, the invention contemplates providing a feed apparatus of the type generally initially described, wherein the feeder plate together with the feed roll forms a clearance or gap extending from an entrance or mouth end of the feeder plate. According to important aspects of the invention, immediately upstream of the feeder plate a presser or contact member is arranged to be movable into a position where a fibre layer is pressed against the feed roll and at least to a distance corresponding to the width of the clearance at the entrance or mouth end of the feeder plate.

The inventive presser member advantageously is arranged to be movable with respect to, and independently of, the feed roll down to a distance with respect to the cylindrical or cylinder roll surface of the feed roll where the fibre layer upstream of the concave feeder plate is pressed against the feed roll. Due to this movement of the presser member the fibre layer is compressed between the presser member and the cylinder surface of the feed roll to such an extent that the fibre material can move into the clearance entrance of the feeder plate without any disturbance. Particularly when piecing the fibre layer the presser member can be pressed against the front end of the fibre layer in such a manner that there can not occur any accumulation of fibre material upstream of the feeder plate clearance. Thus, there is provided an apparatus for compressing and taking-in the fibre layer, which can pre-press the fibre layer in the desired manner for accommodation to the width of the clearance or gap at the entrance of the feeder plate, which clearance or gap is smaller than the thickness of the fibre layer or lap.

According to one advantageous embodiment of the invention the presser member together with the feed roll can form a space extending up to the feeder plate clearance. This space tapers at least down to the clearance width at the entrance of the feeder plate clearance. Preferably, the presser member extends up to the feeder plate in such a manner that the formed space merges into the feeder plate clearance without any gap being formed. There is thus created a gapless or seamless passage or transition from the tapered space into the clearance between the concave feeder plate and the feed roll.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
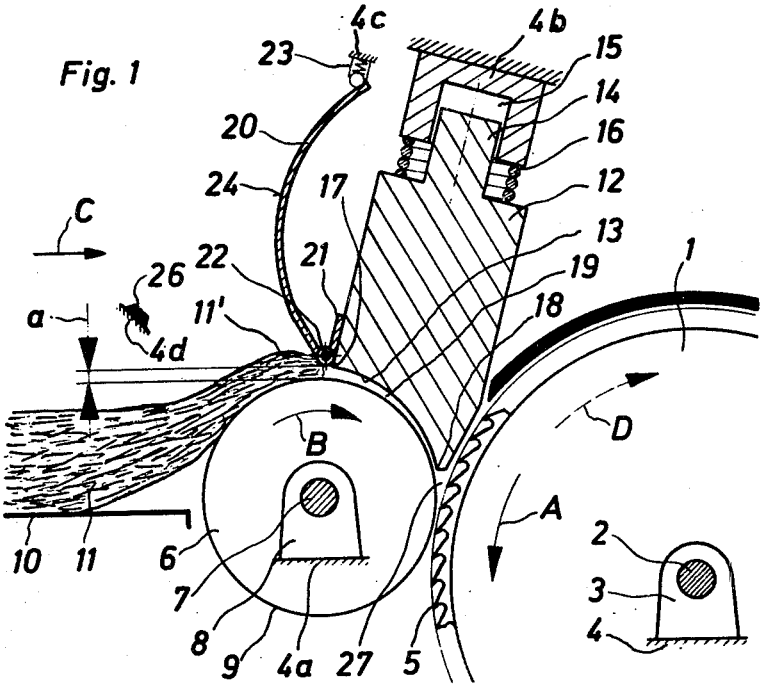
FIG. 1 is a sectional view of a feed apparatus equipped with a presser member constructed according to the teachings of the present invention.
Figure 2:
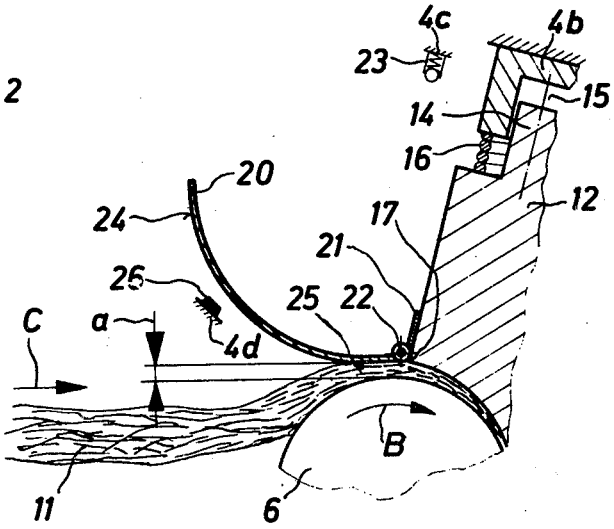
FIG. 2 illustrates details of the feed apparatus according to FIG. 1, the presser member being shown in another position.
Figure 3:
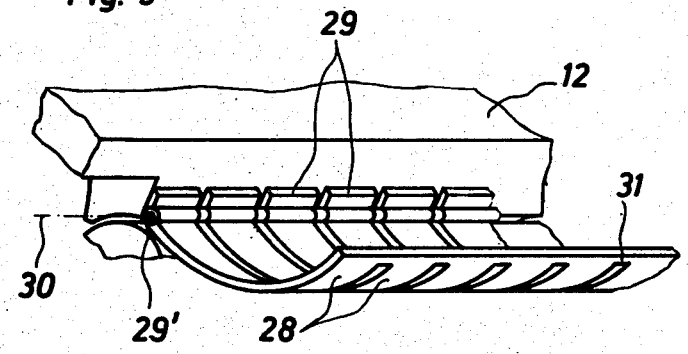
FIG. 3 is an axonometric view of a modified construction of the presser member.

Describing now the drawings and according to the exemplary embodiments shown in FIGS. 1 through 3, an opening roll 1 equipped with a shaft 2 is rotatably supported in a bearing member 3 on a frame part 4 of a card or another spinning preparatory machine (not shown) which is to be fed with a fibre layer 11. The opening roll 1 is provided on its circumference with conventional opening elements, here shown in the form of clothing teeth 5. The opening roll 1 can be driven by any suitable drive in the direction of the arrow A, i.e. counter-clockwise. Arranged upstream of the opening roll 1 and in cooperative relationship thereto is a feed roll 6 which is rotatably supported by means of a shaft 7 in a bearing member 8 on a frame part 4*a*. Feed roll 6 can be driven by any suitable drive in the direction of the arrow B, i.e. opposite to the rotational direction indicated by the arrow A of the opening roll 1. The cylindrical or cylinder surface 9 of the feed roll 6 can be fluted, knurled or provided with clothing. On the side of the feed roll 6 which is opposite the opening roll 1 there is provided a stationary feed table 10 which extends up to the region of the feed roll 6 and serves to support the infed fibre layer 11 or the like.

A feeding trough device or feed device 12 comprising a concave feeder plate or feeding trough element 13 is positioned opposite to the feed roll 6. This feeder plate 13 is movably mounted, by using a piston 14 displaceable within a cylinder 15 provided at or on a frame part 4*b* and is resiliently downwardly biased by the action of a suitable elastic element 16, e.g. a spring or a rubber element. The concave feeder plate 13 extends from a feeder plate entrance or starting region 17 to a feeder plate-nip edge or outlet edge 18 along the circumference of the feed roll 6. A substantially wedge-shaped clearance or gap 19, also called "mouth", is formed between the concave feeder plate 13 and the cylinder surface 9 of the feeder roll 6. The clearance width a of this gap or clearance 19 diminishes from the entrance 17, in the rotational direction B, towards the feeder plate edge 18.

Immediately upstream of the entrance 17, i.e. the entrance of the gap or clearance 19, there is arranged a presser member here shown in the form of a presser plate 20 which is pivotably supported on the concave feed device 12 by a hinge or pivot 21 so as to be pivotable about the axis of a hinge or pivot pin 22 arranged essentially parallel to the lengthwise axis of the feed roll 6. The pivot arrangement 21, 22 works such that the presser plate 20 can be selectively downwardly or upwardly pivoted, as desired. The presser plate or slat 20 is provided with a convex curvature and extends from the clearance entrance 17 and is arrested in its pivoted-up position on a frame part 4*c* by for instance a spring-loaded ball stop 23 or equivalent structure. In FIG. 2 the presser plate 20 is shown in a lowered position, with its curved presser surface 24 together with the cylinder surface 9 forming a space or room 25 extending towards the clearance entrance 17. The width of this space 25 diminishes to the width a of the clearance or gap 19 at the feeder plate entrance 17. For preventing contact with the feed roll 6 there is beneficially provided on a frame part 4*d* a lower stop 26 for the presser plate 20.

The input or infed fibre layer 11 is supplied in known manner by a suitable fibre material supply source, for instance by a lap or a feed chute onto the feed table 10 where it moves in the direction of the arrow C to the feed roll 6. This infed fibre layer 11 is then engaged by the feed roll 6 owing to its clockwise rotational direction B and is pulled-up onto the cylinder surface 9 thereof. For piecing the fibre layer 11 the presser plate 20 is brought to its completely pivoted-up position (FIG. 1).

As soon as the front edge of the fibre layer 11 reaches the entrance 17, the presser plate 20 is manually lowered onto the incoming portion 11' of such fibre layer 11. The presser plate or slat 20 now is placed, as shown in FIG. 2, onto the fibre layer 11 under the action of its own weight and in this position compressed the fibre layer 11 to such an extent that it can pass into the clearance or gap 19 without disturbance. Using the presser plate 20, as shown in FIG. 2, lowered down to a distance essentially corresponding to the width a at the entrance 17, the presser surface 24 facing the feed roll-cylinder surface 9 extends up to the clearance entrance 17 and substantially merges seamlessly i.e. without any gap into the feeder plate 13 in such a manner that the incoming fibre layer 11 is inserted into the concave clearance or gap 19 with a thickness which has been reduced to the width a of such clearance or gap 19. After such insertion operation the presser plate 20 again is pivoted-up and positionally arrested by the ball stop or lock 23, or remains freely placed on the incoming fibre layer 11 in its position as shown in FIG. 2. It can, however, also be additionally pressed down onto the fibre layer if, for instance, the inherent weight of the presser plate 20 is not sufficient, by any suitable pressing or weighting means (not shown).

Upon leaving the nip or outlet edge 18 of the concave presser plate 13, the fibre layer 11 reaches a transfer point 27 in the zone of the clothing 5 of the opening roll 1. As the opening roll 1 rotates in the direction A, opposite to the rotational direction B, the fibre material is taken over by the opening roll 1 without deflection at the transfer point 27 at the region of the nip edge 18, the circumference of the cylinder surface 9 of the feed roll 6 and the clothing 5 moving in the same direction at the transfer point 27. It also is possible to use the inventive feed apparatus on an opening roll which can be driven clockwise, as indicated in FIG. 1 by the arrow D shown with broken or phantom lines. The presser plate 20 extends continuously over the working width of the feed roll 6 and, thus, over the width of the incoming fibre layer 11. Thus, the fibre layer 11 is taken-in evenly and simultaneously across its entire width, particularly during the piecing process, is compressed and inserted into the concave clearance or feed gap 19.

According to the modification of FIG. 3, there also can be provided individual presser plates 28 of convex curvature which are arranged side by side. These presser or pressure plates 28 are supported to be pivotable about an axis 30 on the concave feed device 12 by using hinge or pivot members 29 having hinge pins 29'.

The not particularly referenced free ends of the presser or pressure plates 28 are rigidly mutually connected by a traverse member 31 externally of the common pivoting axis 30 in such a manner that, seen as a whole element or unit, there is formed a slotted presser plate.

Figure 4:
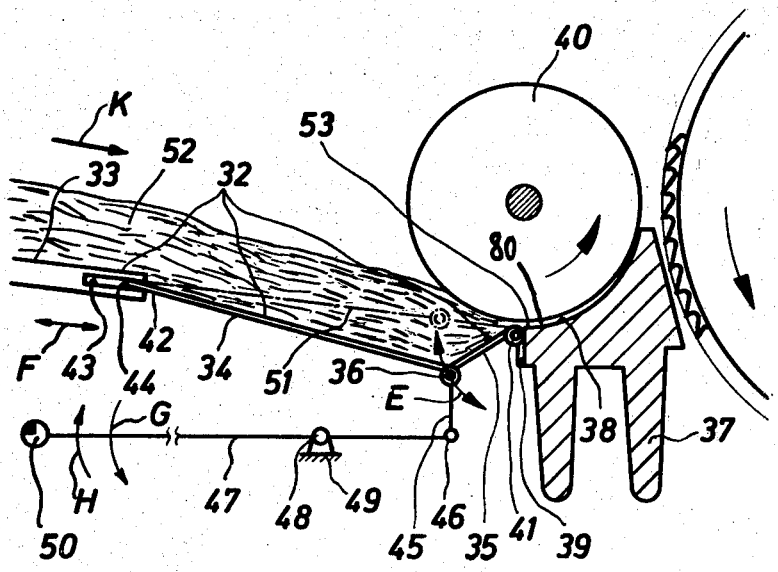
FIG. 4 is a sectional view of another embodiment of a feed apparatus constructed according to the invention.

With the embodiment of FIG. 4 a feed table 32 contains a rigidly or stationarily arranged table portion 33, a movably arranged table plate 34 and also a movably arranged presser plate 35, the movable plates 34 and 35 being mutually pivotably connected by a hinge or pivot 36. The presser plate 35, designed planar or flat in the manner of a table portion, extends towards a feed roll 40 and is arranged on a hinge or pivot 39 to be pivotable about an axis 41 in the direction of the double-headed arrow E. The presser plate 35 is mounted by means of the hinge 39 on a concave feed arrangement or member 37 equipped with a feeding trough or feeder plate 38 defining a clearance of feed gap 80 together with the feed roll 40. The end 42 of the table plate 34 is hinged to a sliding member 44 sliding in a guide track or path 43 in such a manner that it can move in the direction of the double-headed arrow F. The stationary table portion 33 and the guide track or path 43 are provided in a frame portion (not shown). On the pivot or hinge 36 a lever 45 is provided which, via a link 46, is linked or articulated to a two-armed or double-arm lever 47. The fulcrum or pivoting center of the double-arm lever 47 is located in a bearing member 48 of a frame portion 49. If the lever 47 is moved, for instance by using a handle 50 or the like, in the direction of the arrow G, then the presser table plate 35 is lifted in the direction towards the feed roll 40. During this process the end 42 of the table plate 34 moves along the guide track or path 43 and together with the presser plate 35 reaches a pressing position 51 indicated with broken or phantom lines. In inverse sequence the presser plate 35 can be pivoted back into its position indicated with full or solid lines in FIG. 4 by moving the double-arm lever 47 in the direction of the arrow H away from the feed roll 40.

During the piecing operation the table plate 34 and the presser plate 35 are in their positions indicated with solid lines in FIG. 4. Consequently, a fibre layer 52 supplied in the direction of the arrow K can freely move with its front end, seen in the direction of material flow, towards the clearance entrance 53. As the front end of the fibre layer 52 reaches the zone of the clearance entrance 53 the presser table 35 and the table plate 34 are brought into their pressing position in such a manner that the fibre layer 52, before entering the clearance entrance 53, is compressed by the presser table plate 35, and thus, can be taken into the concave clearance or gap 80 without disturbance. If required, the presser table plate 35 and the table plate 34 can be arrested in the phantom line positions 51 by any suitable locking or arresting mechanism (not shown).

According to a further embodiment of the invention, the double-arm lever 47 of the operating handle 50, respectively, can be connected with a drivable crank which periodically pivots the lever 47 in the direction of the arrows G and H, respectively during the insertion of the incoming fibre layer 52 into the feeding trough 38.

Figure 5:
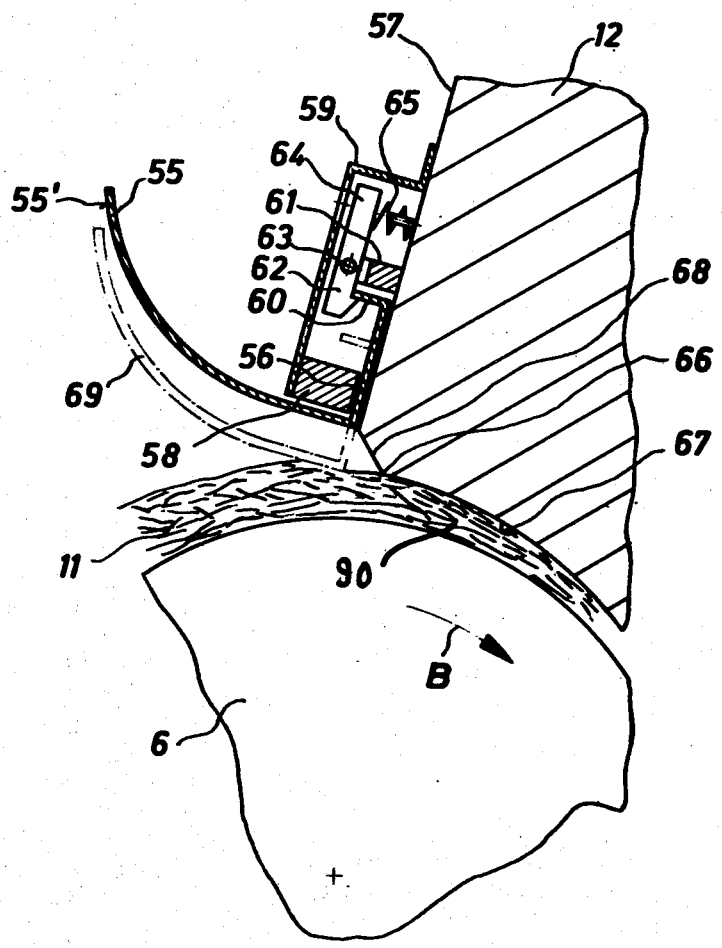
FIG. 5 is a detail sectional view of the feed apparatus according to FIG. 1, utilizing another construction of presser member.

As shown in the further embodiment of FIG. 5, also a presser plate 55 with a curved presser surface 55' can be slidably arranged at a bias to the direction of movement of the fibre layer 11 instead of using a hinging arrangement. By means of its extension 56 the presser plate 55 is freely slidable between a wall portion 57 and a protrusion or projection 58 which is provided at a holder or support 59 connected to the wall portion 57. The projection 58 also acts as a lower stop for a rim or edge 60 angled-off or bent from the extension 56 in order to prevent contact of the presser plate 55 with the feed roll 6. On a protrusion or projection 61 on the wall portion 57 there is pivotably supported on a pin 63 a pawl or latch 62 or the like. The pawl or latch 62 bears against the wall portion 57 under the action of a pressure spring 65 acting on the lever or arm 64 of the latch 62. This pawl or latch 62 meshes with the flexed rim or edge 60 in such a manner that the presser plate is held in an upper position where it is moved away from the feed roll 6. By pressing the latch lever or arm 64 the presser plate 55 can be released and can be lowered towards the feed roll 6 into its pressing position 69 as indicated with broken or phantom lines. At the clearance entrance 66 the feeding trough or feeder plate 67 is provided with an inclined or bevelled portion 68 extending away from the feed roll 6. This inclined portion 68 ensures that the wall portion 57 can not protrude past the presser surface 55' when the presser or pressure plate 55 is in its upper position. Reference character 90 designates the clearance or feed gap formed between the feed roll 6 and feeder plate 67.

The presser members constructed according to the present invention and arranged upstream of the concave clearance and feeding plate or trough, respectively, presents the advantage that the presser member can function independently of the feeding trough or feed plate arrangement. Furthermore, a temporarily upstream located nip can be created for the fibre layer, which nip is positioned upstream of the clearance entrance, and thus, upstream of the feeding trough or feeder plate arrangement and ensures, for instance, for reliable taking-in of the fibre layer by the feed roll, particularly the front end of the supplied fibre layer over the entire width of such fibre layer. The inventive feed apparatus permits reliable insertion of the supplied fibre layer, without disturbances over the whole width of the feed roll. This is extremely advantageous with, for example, machines of large working width, e.g. on cards, the working width of which exceeds 120 centimeters. The use of tools for piecing can be dispensed with, which piecing action, for instance on large machines is difficult, due to the inaccessibility of the middle section or region of the feed roll, if not impossible. Moreover, this piecing operation otherwise presents the danger of damage to machine parts or accidents to the hand of the operator. The inventive apparatus furthermore enables automatic and fast insertion of the fibre layer into the feeding trough arrangement and permits continuous operation of the feed apparatus and the opening roll.

While there are shown and described present preferred embodiments of the invention, it is to be distinctly understood that the invention is not limited thereto, but may be otherwise variously embodied and practiced within the scope of the following claims.

Accordingly, What we claim is:

1. A feed apparatus for a fibre layer on an opening roll of cards or spinning preparatory machines fed with the fibre layer moving in a predetermined direction of travel, comprising:

a feed roll;

a feeder plate having an entrance;

said feeder plate together with said feed roll being positioned to form therebetween a clearance extending from the entrance of the feeder plate;

a presser member arranged at said entrance to and immediately upstream of the feeder plate with respect to the direction of movement of the fibre layer;

means for mounting said presser member to be movable towards the feed roll into a position for compressing the fibre layer and at least to a distance essentially corresponding to the width of said clearance at the entrance of the feeder plate.

2. The feed apparatus as defined in claim 1, wherein:

said feed roll has a substantially cylindrical outer surface;

said presser member including a presser surface;

said mounting means for said presser member enabling said presser member to move into a pressing position where said presser member compresses the fibre layer and with said presser surface facing in the direction of said cylindrical outer surface of the feed roll and with said presser member extending essentially up to the region of the entrance of the feeder plate.

3. The feed apparatus as defined in claim 1, wherein:

said means mounting said presser member enables said presser member to move into a pressing position where it compresses said fibre layer;

said presser member in said pressing position together with said feed roll forming a space extending up to the entrance of the feeder plate;

said space having a width which diminishes at least substantially down to the width of the clearance at the entrance of said feeder plate.

4. The feed apparatus as defined in claim 1, wherein:

said feed roll has a longitudinal axis; and said means for movably mounting said presser member incorporates pivot means for pivotably supporting said presser member and arranged essentially in parallelism with respect to said longitudinal axis of said feed roll.

5. The feed apparatus as defined in claim 1, further including:

a feed table arranged upstream of the feed roll with respect to the direction of movement of the fibre layer; and said means for mounting said presser member positioning said presser member above said feed roll.

6. The feed apparatus as defined in claim 1, wherein:

said presser member comprises at least one presser plate.

7. The feed apparatus as defined in claim 6, wherein:

said feed roll has a substantially cylindrical outer surface;

said presser plate having a surface which faces said feed roll and is convexly curved with respect to said cylindrical outer surface of said feed roll.

8. The feed apparatus as defined in claim 6, including:

a plurality of said presser plates adjacently arranged with respect to one another for forming said presser member.

9. The feed apparatus as defined in claim 8, wherein:

said mounting means for said presser member incorporates structure defining a common pivot axis for said plurality of adjacently arranged presser plates; and means for mutually connecting said plurality of adjacently arranged presser plates externally of said common pivot axis.

10. The feed apparatus as defined in claim 1, wherein:

said presser member comprises a presser table plate.

11. The feed apparatus as defined in claim 10, wherein:

said feed roll has a longitudinal axis;

said means for mounting said presser member comprises structure for pivotably mounting said presser table plate about a pivot axis arranged essentially parallel to said longitudinal axis of the feed roll;

said presser table plate having an end located remote from said feeder plate;

a feed table plate element having opposed ends;

one end of said feed table plate element being arranged adjacent said remote end of said presser table plate;

means for hingedly connecting said adjacent ends of said feed table plate element and said presser table plate;

the other opposed end of said feed table plate element being arranged at a distance from said presser table plate; and guide means within which there is pivotably an slidably supported said other end of said feed table plate element.

12. The feed apparatus as defined in claim 1, further including:

means for positionally arresting said presser member.

13. The feed apparatus as defined in claim 1, wherein:

said means for mounting said presser member incorporates structure for slidably arranging said presser member for movement in a direction towards said feed roll.

14. The feed apparatus as defined in claim 1, wherein:

said means for mounting said presser member enables periodic pivotal movement of said presser member during piecing of the fibre layer.

15. The feed apparatus as defined in claim 1, wherein:

said means for movably mounting said presser member incorporates structure enabling said presser member to be elevationally displaced in the direction of the feed roll.

16. The feed apparatus as defined in claim 15, wherein:

said structure for elevationally displacing said presser member enables lowering of said presser member towards said feed roll.

* * * * *